US008677655B2

(12) United States Patent
Chen

(10) Patent No.: US 8,677,655 B2
(45) Date of Patent: Mar. 25, 2014

(54) SHOE WITH ANTI-SLIP DEVICE

(76) Inventor: Ming Te Chen, Taichung Hsien (TW)

( * ) Notice: Subject to any disclaimer, the term of this patent is extended or adjusted under 35 U.S.C. 154(b) by 674 days.

(21) Appl. No.: 13/005,550

(22) Filed: Jan. 13, 2011

(65) Prior Publication Data

US 2011/0173846 A1 Jul. 21, 2011

Related U.S. Application Data

(60) Provisional application No. 61/296,029, filed on Jan. 19, 2010.

(51) Int. Cl.
*A43C 15/14* (2006.01)

(52) U.S. Cl.
USPC ..... 36/61; 36/59 R; 36/59 C

(58) Field of Classification Search
USPC ..... 36/59 R, 59 C, 61, 102, 67 R
See application file for complete search history.

(56) References Cited

U.S. PATENT DOCUMENTS

| | | | | | |
|---|---|---|---|---|---|
| 264,105 | A * | 9/1882 | Rust | 36/61 |
| 1,134,228 | A * | 4/1915 | Rightor | 36/61 |
| 1,335,387 | A * | 3/1920 | Petrauskas | 36/61 |
| 1,565,290 | A * | 12/1925 | Noel | 36/61 |
| 3,717,238 | A * | 2/1973 | Fox | 36/61 |
| 4,271,608 | A * | 6/1981 | Tomuro | 36/61 |
| 4,667,423 | A * | 5/1987 | Autry et al. | 36/102 |
| 4,715,133 | A * | 12/1987 | Hartjes et al. | 36/127 |
| 5,077,916 | A * | 1/1992 | Beneteau | 361/114 |
| 5,367,791 | A * | 11/1994 | Gross et al. | 36/31 |
| 7,392,605 | B2 * | 7/2008 | Hatfield et al. | 36/97 |
| 7,523,566 | B2 * | 4/2009 | Young-Chul | 36/30 R |

* cited by examiner

*Primary Examiner* — Ted Kavanaugh

(57) ABSTRACT

A shoe includes a vamp, an insole, a flexible pad, a spike set, a mediate part and an outsole part. The flexible pad includes multiple slits and the spikes of the spike set are inserted into the slits. The combination of the flexible pad 11 and the spike set are connected to the mediate part and the insole is connected to the top of the combination by way of injection molding. The vamp is connected to the mediate part and the outsole part is connected to the mediate part and the mediate part by way of injection molding. The flexible pad and the spike set protrude out from the underside of the outsole part.

14 Claims, 4 Drawing Sheets

SHOE WITH ANTI-SLIP DEVICE

FIELD OF THE INVENTION

The present invention relates to a shoe, and more particularly, to a shoe with anti-slip device which is flexible and replaceable.

BACKGROUND OF THE INVENTION

A conventional waterproof anti-slip shoe includes an insole which includes multiple ridges which provide anti-slip function, and a spike set is integrally formed with the insole and protrudes out from the underside of the insole. The distal ends of the spikes are in flush with the ridges. A vamp is integrally connected on the top of the insole. Each of the spikes includes multiple tips which extend outward. The shanks and the tips are provided with wrinkles so as to be securely connected with the insole. The ridges are located alternatively to the spikes. Therefore, the spikes can bite the slippery surface and the ridges provide further friction.

However, the spikes are spread to certain portions of the underside of the shoe so that when the surface that the shoe is stepped on includes irregular surface, the spikes might not above to bite the surface and the wearer could slip.

Besides, the anti-slip shoe usually includes a thin outsole which allows the wearer to feel the geographic condition of the surface that he/she steps on. In order to make the spike set securely connected to the insole, the conventional spike set is in T shape so that the wearer does not feel comfortable.

Furthermore, the spike set is integrally formed with the insole so that it cannot be recycled and re-use.

The present invention intends to provide a shoe with anti-slip device which includes flexible pads with stiff spikes inserted into the slits of the flexible pads. The shoe is comfortable and the anti-device can be recycled and replaced.

SUMMARY OF THE INVENTION

The present invention relates to a shoe and comprises a flexible pad having multiple slits defined therein and two restriction portions are connected to two ends of each slit. A spike set includes spikes and two end sections extend from two ends of each spike. The spikes are inserted into the slits of the flexible pad and the end sections ensure that the spikes are not drop from the slits. A mediate part has a skirt on a periphery thereof and a hole defined through the mediate part. An insole is located on a top of the mediate part and a vamp is connected to the skirt of the mediate part. An outsole part has a space in which the vamp and the mediate part are securely accommodated. The flexible pad and the spike set protrude out from an underside of the outsole part.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
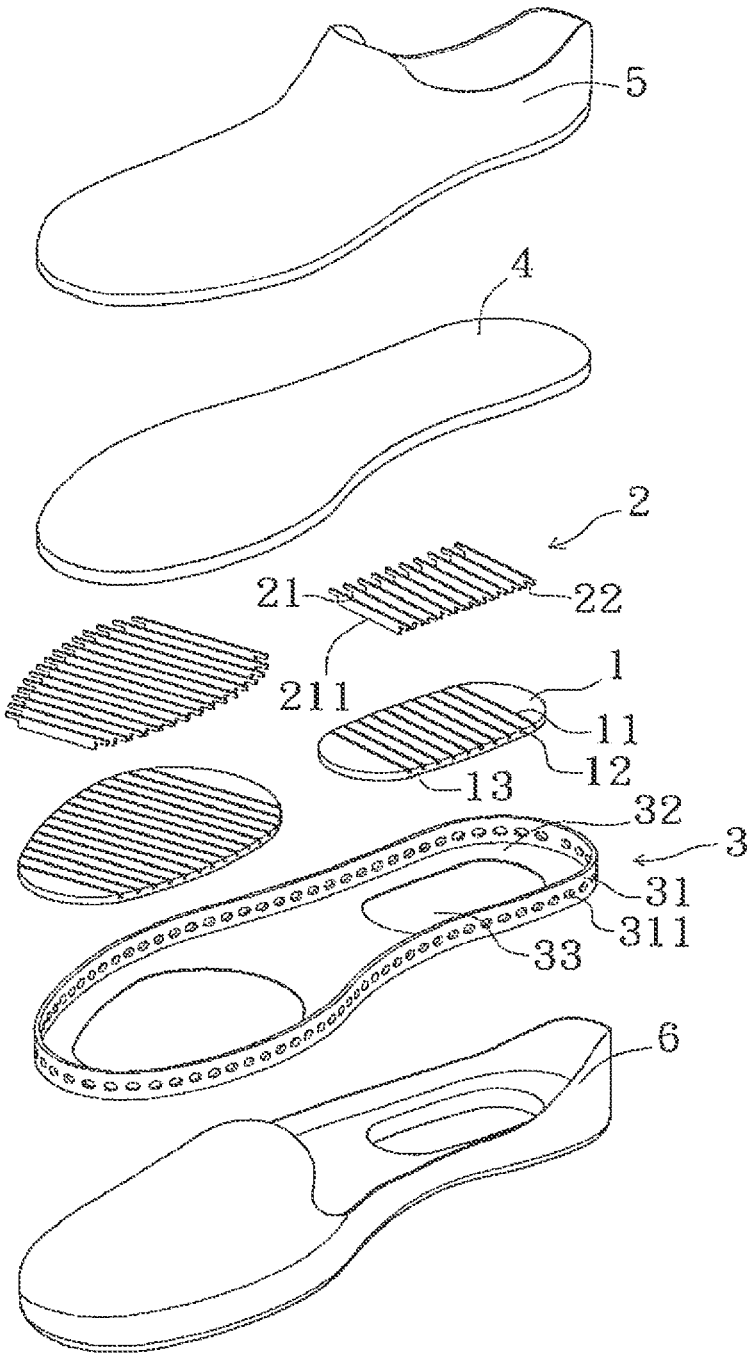
FIG. 1 is an exploded view to show the shoe of the present invention.
Figure 2:
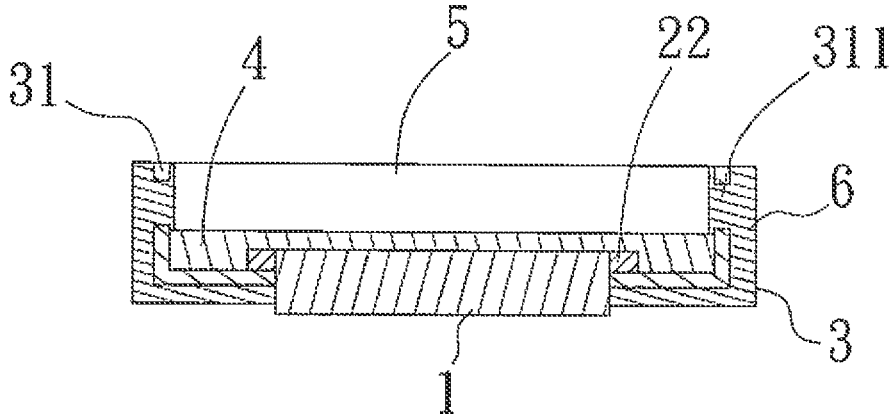
FIG. 2 is an end cross sectional view of the shoe of the present invention.
Figure 3:
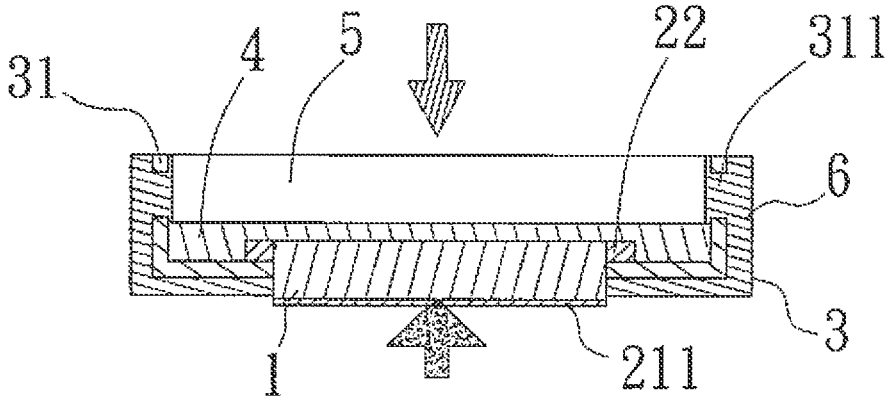
FIG. 3 is an end cross sectional view of the shoe of the present invention, wherein the spikes protrude out from the flexible pad when applied a force.
Figure 4:
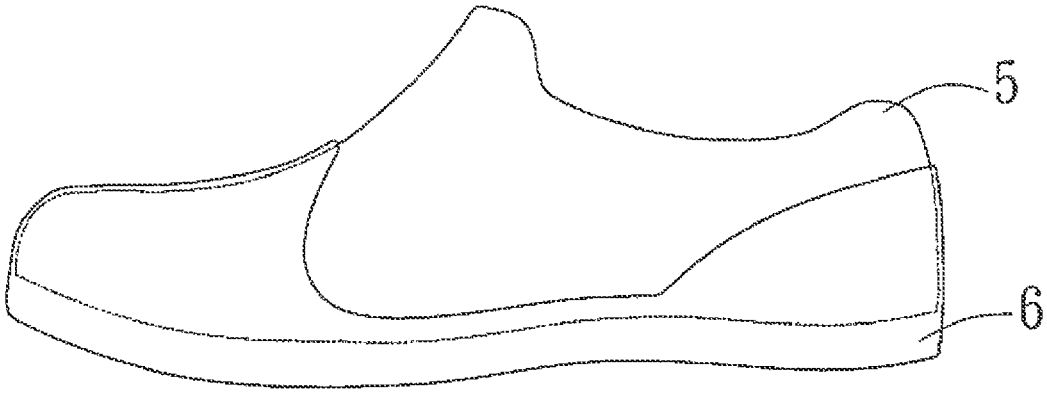
FIG. 4 is a side view of the shoe of the present invention.

Referring to FIGS. 1 to 4, the shoe of the present invention comprises two flexible pads 1 and each are made by soft and anti-slip material. Each flexible pad 1 has multiple slits 11 defined therein and two restriction portions 12 are connected to two ends of each slit 11.

Two spike sets 2 each have spikes 21 and two end sections 22 extend from two ends of each spike 21. The spikes 21 are made by hard material and inserted into the slits 11 of the flexible pad 1. The distal edge 211 of the spikes 21 are in flush with the underside 13 of the flexible pad 1. The width of each of the spikes 21 is larger than a width of the flexible pad 1 that the spikes 21 are connected so that when the spikes 21 are inserted into the slits 11, the end sections 22 protrude out from two sides of the flexible pad 1. Therefore, the spikes 21 do not drop from the slits 11.

A mediate part 3 has a skirt 31 on a periphery thereof so as to form a recessed room. Two holes 33 are defined through the inner end 32 of the mediate part 3. The sizes of the holes 33 are matched with the sizes of the flexible pads 1 which are engaged with the holes 33. Because the end sections 22 extend beyond the restriction portions 12 of the pads 1, so that the flexible pads 1 do not drop from the holes 33.

An insole 4 is located on a top of the mediate part 3 by way of injection molding to cover the flexible pads 1 and the spike sets 2. The insole 4 is integrally connected to an inner end 32 of the mediate part 3, or the insole 4 and the mediate part 3 are two individual parts.

A vamp 5 has its height according designs of the shoes and is connected to the skirt 31 of the mediate part 3 by way of stitching, heat pressing or gluing. A space is defined between the vamp 5 and the mediate part 3. After the vamp 5 and the mediate part 3 are connected to each other, the combination of the vamp 5 and the mediate part 3 are processed by a machine (not shown) to fill the space with melted material and the melted material also coated outside of the vamp 5 and the mediate part 3. The flexible pads 1 and the spike sets protrude out from the underside of the vamp 5.

An outsole part 6 has a space in which the vamp 5 and the mediate part 3 are securely accommodated. The outsole part 6 is connected to the vamp 5 by way of injection molding. The flexible pads 1 and the spike sets 2 protrude out from the underside of the outsole part 6.

When the shoes are not in use, the flexible pad 1 and the spike set 2 are in flush with the underside of the outsole part 6, the spikes 21 are hidden in the flexible pads 1. When the user wears the shoes and applies a force to the shoes, because the flexible pads 1 are made by soft material, which is narrowed by the force and the reaction force from the surface that the shoes are stepped, so that the spikes 21 protrude out from the flexible pads 1 to have the anti-slip feature. The flexible pads 1 provide proper friction to reinforce the anti-slip feature. Besides, the spikes 21 are elongate plate like spikes and located substantially in parallel to each other, so that when stepping on an irregular surface, there will be more than two or three contact points between the spikes 21 and the surface.

The insole 4 is located between the top of the spike sets 2 and the underside of the vamp 5, so that the wearers feel comfortable.

Figure 5:
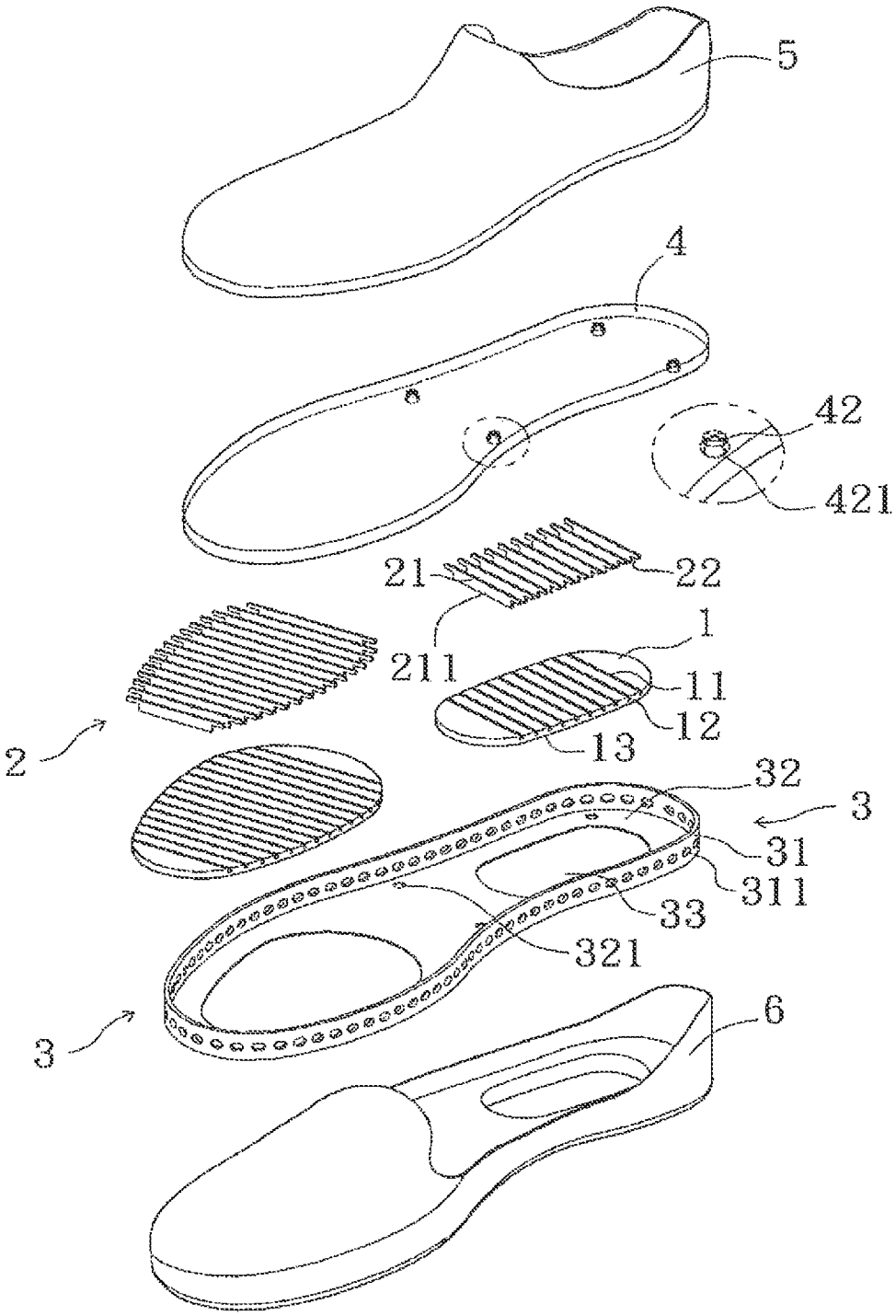
FIG. 5 is an exploded view to show another embodiment of the shoe of the present invention.

FIG. 5 shows another embodiment of the shoe of the present invention, wherein the changes relative to the previous embodiment are that the insole 4 is made according the size of the vamp 5 and the inner periphery of the mediate part 3, and the underside of the insole 4 includes engaging pieces 42 extending therefrom. The engaging pieces 42 each have a protrusion 421 at a distal end thereof.

The mediate part 3 has a skirt 31 on a periphery thereof, and two holes 33 and engaging holes 321 are defined through the mediate part 3. The engaging pieces 42 are engaged with the engaging holes 321 and the protrusions 421 restrict the engaging pieces 42 from being separated from the engaging holes 321. When the spikes 21 are inserted into the slits 11 and the flexible pads 1 are engaged with the holes 33, the insole 4 is put on the inner end of the mediate part 3 by simply inserting the engaging pieces 42 into the engaging holes 321. This can saves one time of injection molding. This way saves the expense of the injection molding and saves also the time for waiting the insole 4 to dry.

Because the insole 4 is connected to the mediate part 3 by the engagement of the engaging pieces 42 into the engaging holes 321, so that when the spike sets 2 or the flexible pads 1 need to be replaced, the insole 4 can be easily removed from the mediate part 3 by pushing the engaging pieces 42 from the engaging holes 321. The removed flexible pads 1 and the spike sets 2 can be recycled and maintained.

While we have shown and described the embodiment in accordance with the present invention, it should be clear to those skilled in the art that further embodiments may be made without departing from the scope of the present invention.

What is claimed is:

1. A shoe comprising:

a flexible pad having multiple slits defined therein and two restriction portions connected to two ends of each slit;

a spike set having spikes and two end sections extending from two ends of each spike, the spikes inserted into the slits of the flexible pad;

a mediate part having a skirt on a periphery thereof and a hole defined through the mediate part;

an insole located on a top of the mediate part;

a vamp connected to the skirt of the mediate part, and an outsole part having a space in which the vamp and the mediate part are securely accommodated, the flexible pad and the spike set protruding out from an underside of the outsole part.

2. The shoe as claimed in claim 1, wherein the flexible pad is made by soft and anti-slip material.

3. The shoe as claimed in claim 1, wherein the spike set is made by hard material.

4. The shoe as claimed in claim 1, wherein a width of each of the spikes is larger than a width of the flexible pad so that when the spike is inserted into the slit, the end sections protrude out from two sides of the flexible pad.

5. The shoe as claimed in claim 1, wherein the vamp and the mediate part are connected to each other by way of stitching, heat pressing or gluing.

6. The shoe as claimed in claim 1, wherein the insole is integrally connected to an inner end of the mediate part, or the insole and the mediate part are two individual parts.

7. The shoe as claimed in claim 1, wherein a space is defined between the vamp and the mediate part.

8. A shoe comprising:

a flexible pad having multiple slits defined therein and two restriction portions connected to two ends of each slit;

a spike set having spikes and two end sections extending from two ends of each spike, the spikes inserted into the slits of the flexible pad;

a mediate part having a skirt on a periphery thereof, a hole and engaging holes defined through the mediate part;

an insole located on a top of the mediate part and having engaging pieces extending from an underside thereof, the engaging pieces each having a protrusion at a distal end thereof, the engaging pieces engaged with the engaging holes and the protrusions restricting the engaging pieces from being separated from the engaging holes;

a vamp connected to the skirt of the mediate part, and an outsole part having a space in which the vamp and the mediate part are securely accommodated, the flexible pad and the spike set protruding out from an underside of the outsole part.

9. The shoe as claimed in claim 8, wherein the flexible pad is made by soft and anti-slip material.

10. The shoe as claimed in claim 8, wherein the spike set is made by hard material.

11. The shoe as claimed in claim 8, wherein a width of each of the spikes is larger than a width of the flexible pad so that when the spike are inserted into the slit, the end sections protrude out from two sides of the flexible pad.

12. The shoe as claimed in claim 8, wherein the insole is integrally formed with an inner end of the mediate part.

13. The shoe as claimed in claim 8, wherein the vamp and the mediate part are connected to each other by way of stitching, heat pressing or gluing.

14. The shoe as claimed in claim 8, wherein a space is defined between the vamp and the mediate part.

* * * * *